US009212018B2

(12) United States Patent
Mutsuno

(10) Patent No.: US 9,212,018 B2
(45) Date of Patent: Dec. 15, 2015

(54) SHEET PROCESSING APPARATUS AND METHOD OF CONTROLLING THE APPARATUS, AND STORAGE MEDIUM

(71) Applicant: CANON KABUSHIKI KAISHA, Tokyo (JP)

(72) Inventor: Masahiro Mutsuno, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/168,302

(22) Filed: Jan. 30, 2014

(65) Prior Publication Data

US 2014/0145394 A1 May 29, 2014

Related U.S. Application Data

(63) Continuation of application No. 13/451,809, filed on Apr. 20, 2012, now Pat. No. 8,672,317.

(30) Foreign Application Priority Data

Apr. 20, 2011 (JP) ..... 2011-094375

(51) Int. Cl.

| | |
|---|---|
| ***B65H 43/06*** | (2006.01) |
| ***G03G 15/00*** | (2006.01) |
| ***B65H 33/00*** | (2006.01) |

(52) U.S. Cl.

CPC ..... *B65H 43/06* (2013.01); *B65H 33/00* (2013.01); *G03G 15/502* (2013.01); *G03G 15/5087* (2013.01); *G03G 15/6541* (2013.01); *G03G 2215/00109* (2013.01); *G03G 2215/00814* (2013.01); *G03G 2215/00818* (2013.01); *G03G 2215/00827* (2013.01)

(58) Field of Classification Search

CPC .... B65H 33/00; B65H 43/06; B65H 2551/10; B65H 2551/20; B65H 2601/271

USPC ..... 271/176

See application file for complete search history.

(56) References Cited

U.S. PATENT DOCUMENTS

| | | | | |
|---|---|---|---|---|
| 3,951,264 | A | 4/1976 | Heidecker et al. | |
| 6,168,145 | B1 * | 1/2001 | Tanaka et al. | 270/58.11 |
| 8,385,765 | B2 | 2/2013 | Inoue | |
| 8,672,317 | B2 * | 3/2014 | Mutsuno | 271/176 |
| 8,672,324 | B2 * | 3/2014 | Ikarashi | 271/279 |

(Continued)

FOREIGN PATENT DOCUMENTS

| | | | |
|---|---|---|---|
| CN | 101126970 | A | 2/2008 |
| CN | 101408742 | A | 4/2009 |

(Continued)

OTHER PUBLICATIONS

Notification of First Office Action for corresponding CN201210118599.X, mail date May 30, 2014. English translation provided.

Official Action issued in JP2011-094375, mailed Feb. 16, 2015.

*Primary Examiner* — David H Bollinger

(74) *Attorney, Agent, or Firm* — Rossi, Kimms & McDowell LLP

(57) ABSTRACT

A sheet count at which printed sheets are stacked on a sheet stacking unit is received from a user. It is controlled to divide the printed sheets into sheets at the sheet count received from the user and stack the printed sheets on the sheet stacking unit.

8 Claims, 15 Drawing Sheets

(56) References Cited

U.S. PATENT DOCUMENTS

| | | | | |
|---|---|---|---|---|
| 2003/0137099 | A1 | 7/2003 | Saito | |
| 2003/0222396 | A1 | 12/2003 | Kurahashi et al. | |
| 2008/0042342 | A1 | 2/2008 | Tominaga et al. | |
| 2009/0097060 | A1 | 4/2009 | Okada | |
| 2009/0224467 | A1 | 9/2009 | Mori | |
| 2010/0003046 | A1 | 1/2010 | Tsujita | |
| 2010/0161112 | A1 | 6/2010 | Kurakata | |
| 2011/0008066 | A1 | 1/2011 | Inoue | |
| 2011/0316225 | A1 | 12/2011 | Takahashi | |
| 2012/0267849 | A1* | 10/2012 | Mutsuno | 271/279 |

FOREIGN PATENT DOCUMENTS

| | | | |
|---|---|---|---|
| CN | 101620391 | A | 1/2010 |
| CN | 101950134 | A | 1/2011 |
| JP | 2009208899 | A | 9/2009 |
| JP | 2010-143718 | A | 7/2010 |

* cited by examiner

SHEET PROCESSING APPARATUS AND METHOD OF CONTROLLING THE APPARATUS, AND STORAGE MEDIUM

BACKGROUND OF THE INVENTION

1. Field of the Invention

The present invention relates to a sheet processing apparatus which conveys, to a sheet stacking means, sheets printed by executing a job, and stacks them on the sheet stacking means, and a method of controlling the apparatus, and a storage medium.

2. Description of the Related Art

Some printing apparatuses such as a POD printing apparatus can connect a stacker having a capacity large enough to store a large volume of printed sheets, together with a post processing apparatus (see Japanese Patent Laid-Open No. 2010-143718). The stacker can store supplied sheets by stacking them on a plurality of stacker trays. As one use case, a large volume of printed sheets are directly packed using such a stacker.

To pack sheets stacked on each tray of the stacker, it is necessary to designate a sheet count at which sheets are stacked on each tray, divide sheets at every designated sheet count, and stack them on respective trays. However, the conventional technique could neither divide nor stack sheets at every sheet count designated by a user.

SUMMARY OF THE INVENTION

An aspect of the present invention is to eliminate the above-mentioned problems with the conventional technology.

The feature of the present invention is to divide sheets at every sheet count designated by the user and stack them on a stacker.

According to an aspect of the present invention, there is provided a sheet processing apparatus for controlling stacking of printed sheets on a sheet stacking unit, the apparatus comprising: a receiving unit configured to receive, from a user, a sheet count at which printed sheets are to be stacked on the sheet stacking unit; and a stacking control unit configured to control division of the printed sheets into a sheet count corresponding to the sheet count received by the receiving unit and to stack the sheets on the sheet stacking unit in accordance with the sheet count received by the receiving unit.

According to an aspect of the present invention, there is provided a method of controlling a sheet processing apparatus for stacking printed sheets on a sheet stacking unit, the method comprising: a receiving step of receiving, from a user, a sheet count at which printed sheets are stacked on the sheet stacking unit; and a stacking control step of controlling to divide the printed sheets into a sheet count corresponding to the sheet count received in the receiving step and stacking the sheets on the sheet stacking unit in accordance with the sheet count received in the receiving step.

Further features and aspects of the present invention will become apparent from the following description of exemplary embodiments, with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Embodiments of the present invention will be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

To solve the problems described in the conventional art, the embodiment assumes a printing environment such as the POD environment different from the office environment. A system environment at the entire site of the POD environment including a printing system 1000 will be explained. The printing environment itself is a feature of the embodiment. In the embodiment, a printing environment to which the printing system 1000 is applicable is suited to even the POD environment and thus will be called a POD system 10000.

Figure 1:
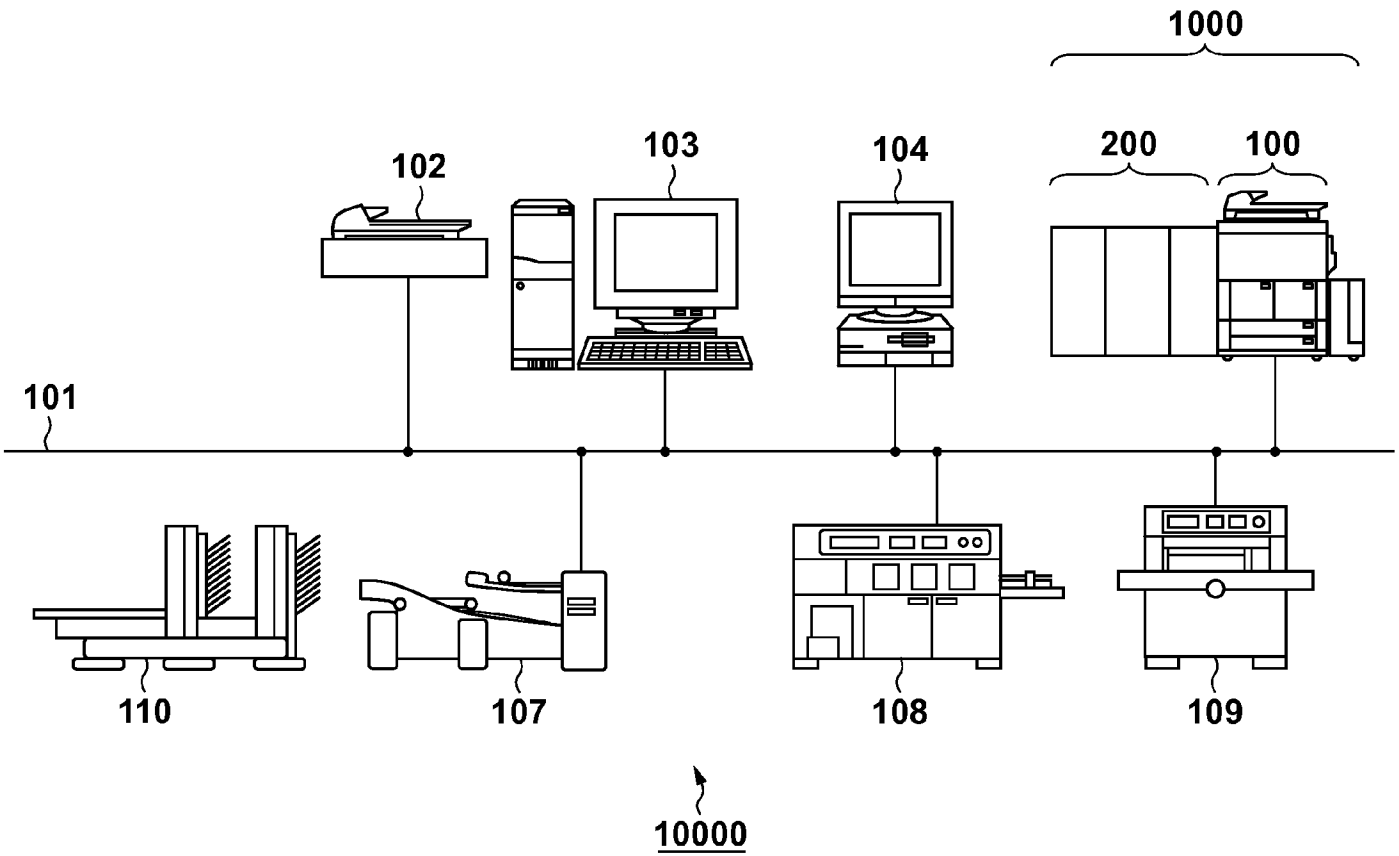
FIG. 1 depicts a view illustrating a POD system according to an embodiment.

FIG. 1 depicts a view illustrating the POD system according to the embodiment.

The POD system 10000 includes the printing system 1000 according to the embodiment, and a server computer 103 and client computer 104 (which will be referred to as PCs). The POD system 10000 also includes a sheet folding apparatus 107, case binding apparatus 108, sheet cutting apparatus 109, saddle stitching apparatus 110, and scanner 102. The POD system 10000 is configured by connecting these apparatuses to each other via a network 101.

The printing system 1000 includes a printing apparatus 100 and sheet processing apparatuses 200. Note that the printing apparatus 100 will be exemplified as a multi-function peripheral having a plurality of functions such as the copy function and PC print function. However, the printing apparatus 100 may be a single-function printing apparatus having only the print function of printing print data from a PC or the copy function. The multi-function peripheral will also be abbreviated as MFP.

The sheet folding apparatus 107, sheet cutting apparatus 109, saddle stitching apparatus 110, and case binding apparatus 108 will be defined as the sheet processing apparatuses 200 in the printing system 1000. These apparatuses are devices capable of executing sheet processes for sheets printed by the printing apparatus 100 of the printing system 1000. For example, the sheet folding apparatus 107 folds sheets printed by the printing apparatus 100. The sheet cutting apparatus 109 cuts sheets printed by the printing apparatus 100 in the unit of a bundle of sheets. The saddle stitching apparatus 110 saddle-stitches sheets printed by the printing apparatus 100. The case binding apparatus 108 case-binds a bundle of sheets printed by the printing apparatus 100.

To execute various sheet processes by these sheet processing apparatuses, the operator needs to take out, from the discharge unit of the printing apparatus 100, materials (printed sheets) which have been printed by the printing apparatus 100 in accordance with a job, and set them in a target sheet processing apparatus. In this way, when a sheet processing apparatus other than the sheet processing apparatuses 200 (FIG. 3) of the printing system 1000 is used, intervention work by the operator is necessary after print processing by the printing apparatus 100. This will be called offline processing.

When executing sheet processes for sheets printed by the printing apparatus 100 by using the sheet processing apparatuses 200 (FIG. 3) of the printing system 1000, intervention work by the operator is unnecessary after executing print processing by the printing apparatus 100. This is because sheets printed by the printing apparatus 100 can be directly supplied from the printing apparatus 100 to the sheet processing apparatus 200. This will be called inline processing.

More specifically, a sheet conveyance path in the printing apparatus 100 can be coupled to a sheet conveyance path in the sheet processing apparatus 200. The sheet processing apparatus 200 and printing apparatus 100 of the printing system 1000 are physically connected to each other. In addition, both the printing apparatus 100 and sheet processing apparatus 200 include CPUs and can communicate data with each other. Hence, the printing apparatus 100 and sheet processing apparatus 200 are electrically connected to each other.

The configuration of the printing system 1000 according to the embodiment will be explained with reference to FIG. 2.

Figure 2:
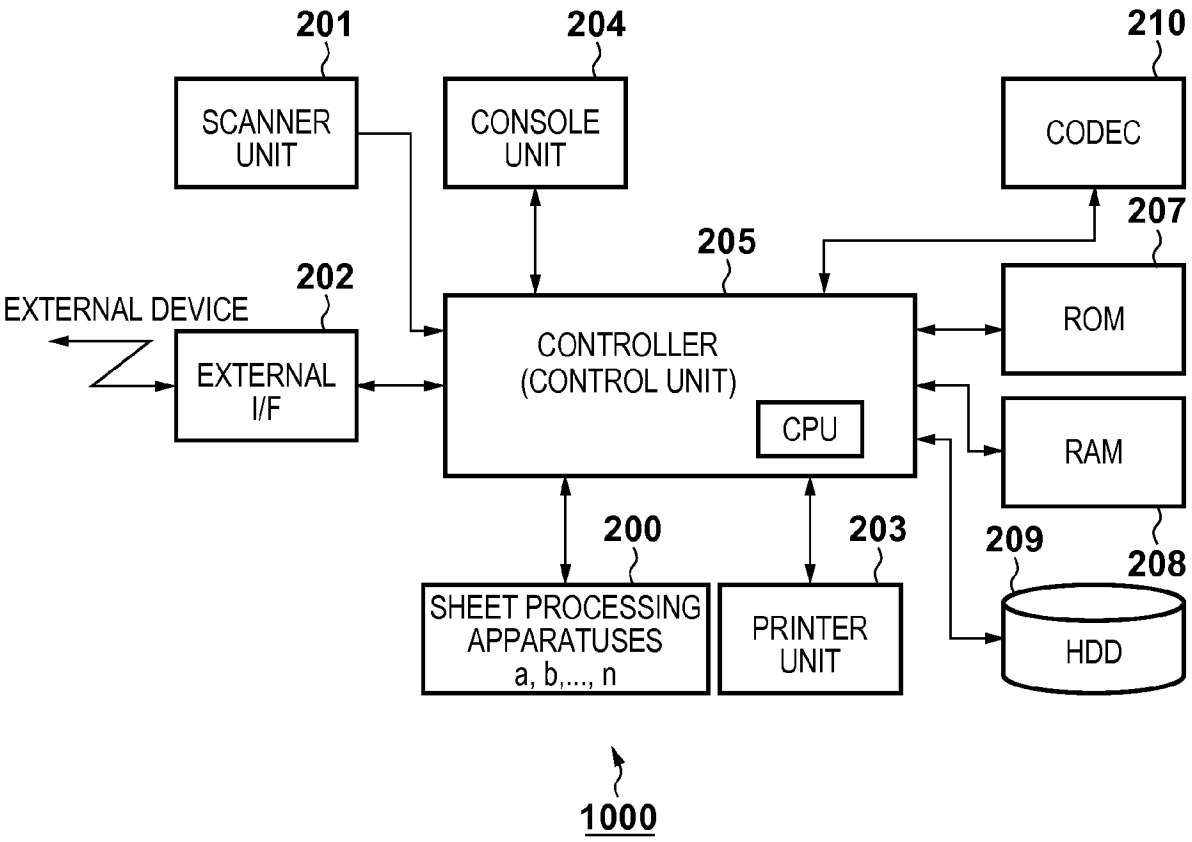
FIG. 2 is a block diagram showing the configuration of a printing system.

FIG. 2 is a block diagram showing the configuration of the printing system 1000. The printing apparatus 100 incorporates all the units of the printing system 1000 in FIG. 2 except for the sheet processing apparatuses 200 (a series of sheet processing apparatuses configurable by a plurality of inline type sheet processing apparatuses). The sheet processing apparatus 200 is a sheet processing apparatus detachable from the printing apparatus 100, and can be provided as an option for the printing apparatus 100. This configuration has an effect of, for example, providing a necessary number of necessary inline finishers in the POD environment.

The printing apparatus 100 includes a nonvolatile memory such as a hard disk 209 (to be referred to as an HDD) capable of storing data for a job that is to undergo a plurality of processes. The printing apparatus 100 has a copy function of temporarily storing image data sent from a scanner unit 201 of the printing apparatus 100 in the HDD 209, reading it out from the HDD 209, and printing it by a printer unit 203. Further, the printing apparatus 100 has a print function of storing, in the HDD 209, job data accepted via an external I/F 202 from an external apparatus such as the PC 103 or 104 (FIG. 1), and printing it by the printer unit 203. In other words, the printing apparatus 100 according to the embodiment can be a printing apparatus capable of color printing or a printing apparatus capable of monochrome printing as long as it can execute various control operations to be described in the embodiment.

The printing apparatus 100 also includes a console unit 204 with a display unit, which is an example of the user interface (UI) of the printing system 1000. Other examples of the user interface provided by the printing system 1000 are the display units, keyboards, and pointing devices of the PCs 103 and 104.

A controller (control unit) 205 serving as an example of the control unit of the printing system 1000 executively controls the processes, operations, and the like of various units of the printing system 1000. A ROM 207 stores various control programs to be executed by the CPU of the control unit 205 according to the embodiment. The ROM 207 stores a display control program for displaying various UI screens including a user interface screen (to be referred to as a UI screen) on the display unit of the console unit 204. The CPU of the control unit 205 can execute various operations according to the embodiment by reading out a program from the ROM 207 and executing it. Also, the ROM 207 stores a program for interpreting PDL (Page Description Language) code data received from an external apparatus (for example, the PC 103 or 104) via the external I/F 202, and rasterizing it into raster image data (bitmap image data). A RAM 208 stores image data sent from the scanner unit 201 or via the external I/F 202, various programs, and setting information. The HDD 209 stores image data compressed by a codec 210. The HDD 209 can hold a plurality of items of data such as print data of a job to be processed. The control unit 205 can print data of a job to be processed that have been input via various input units such as the scanner unit 201 and external I/F 202, or transmit them to an external apparatus via the external I/F 202. In this way, the control unit 205 controls various output processes for data of a job to be processed that is stored in the HDD 209. The codec 210 compresses/decompresses image data and the like stored in the RAM 208 or HDD 209 according to various compression methods such as JBIG and JPEG.

With the above arrangement, the control unit 205 of the printing system 1000 controls even the operation of the inline type sheet processing apparatus 200.

Figure 3:
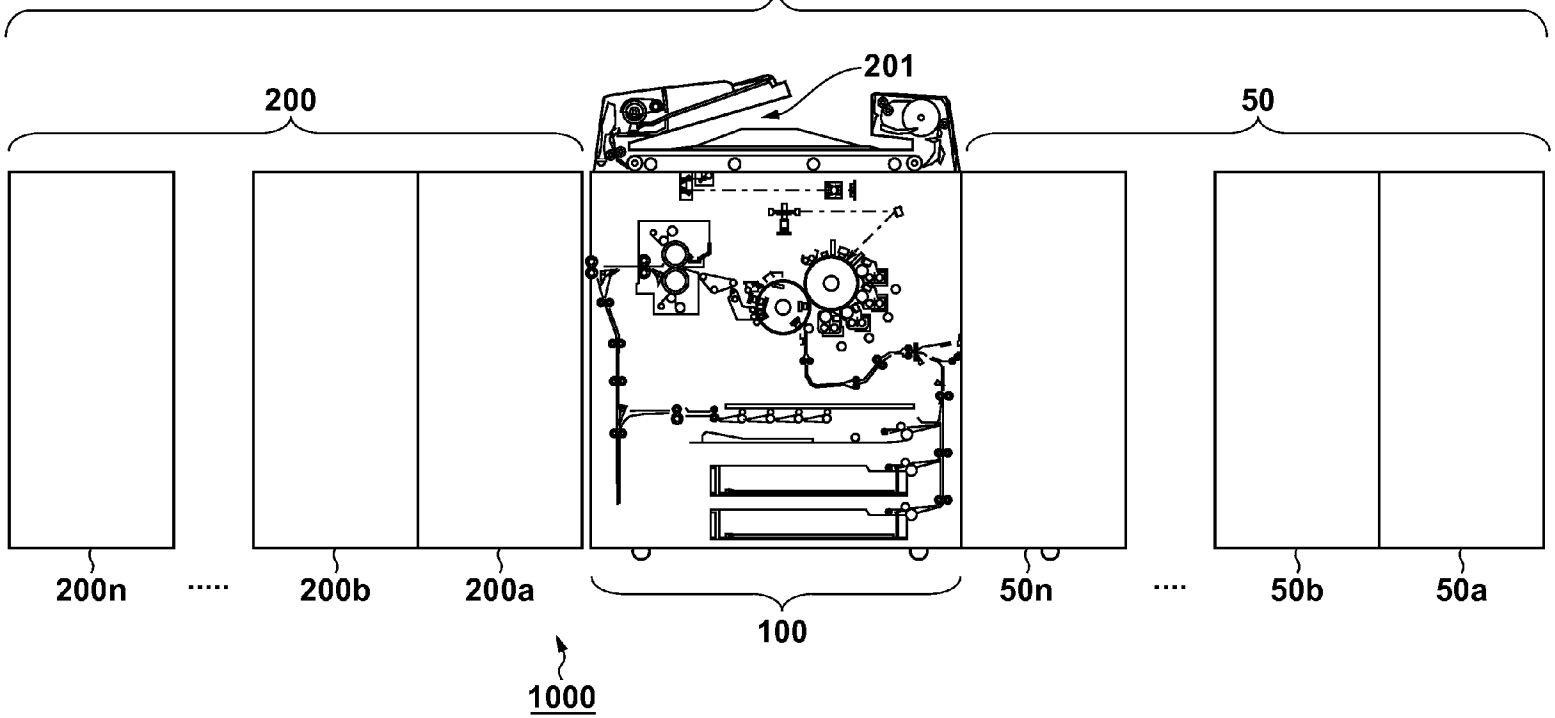
FIG. 3 depicts a view illustrating the structure of the printing system according to the embodiment.

FIG. 3 depicts a view illustrating the structure of the printing system 1000 according to the embodiment.

As described above, the printing system 1000 allows cascade-connecting a plurality of inline type sheet processing apparatuses to the printing apparatus 100. To enhance the effects of the embodiment under specific restrictions, an arbitrary number of inline type sheet processing apparatuses which can be connected to the printing apparatus 100 and can execute inline processes can be installed in accordance with a use environment. In FIGS. 2 and 3, N sheet processing apparatuses 200 are connectable as a series of sheet processing apparatuses for descriptive convenience. The sheet processing apparatuses 200 are denoted as sheet processing apparatuses 200*a*, 200*b*, . . . sequentially from the first sheet processing apparatus, and the Nth sheet processing apparatus is denoted as a sheet processing apparatus 200*n*. In this fashion, an arbitrary number of inline type sheet processing apparatuses can be connected. To increase the use efficiency of an offline type sheet processing apparatus which executes offline processing, the embodiment assumes even a POD environment where the administrator determines that no inline type sheet processing apparatus is necessary. For example, even when no inline type sheet processing apparatus is used, the printing apparatus 100 according to the embodiment is usable. Also, when cascade-connecting a plurality of inline type sheet processing apparatuses to the printing apparatus 100, a specific user such as the administrator can arbitrarily change and determine, under constraints, even the order in which these sheet processing apparatuses are connected. However, this mechanism improves user friendliness, and is not always an indispensable constituent requirement. That is, the present invention should not be interpreted within this configuration. Further, the system may be configured so that the number and connection order of inline type sheet processing apparatuses available in the printing system 1000 are defined uniformly. The present invention includes all system configurations and all apparatus arrangements as long as at least one of various jobs can be executed.

In addition, a plurality of large-volume sheet feeding apparatuses 50, that is, 50*a*, 50*b*, . . . , 50*n* can be connected to the printing apparatus 100. The printing apparatus 100 includes the scanner unit 201 at the top, and includes a printer engine which forms (prints) an image by electrophotography. Note that the image forming method by the printer engine is well known, and a description thereof will be omitted.

Figure 4:
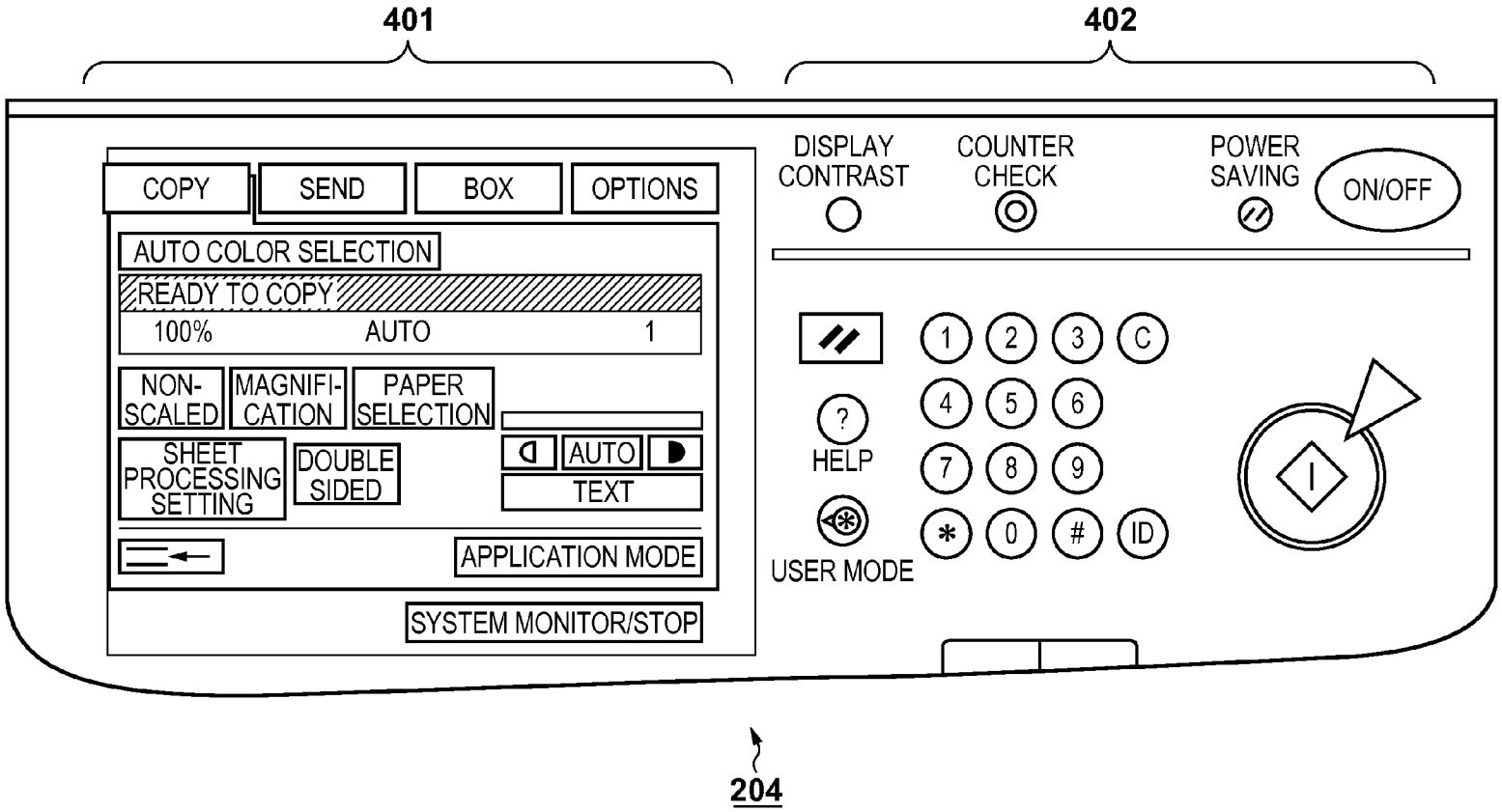
FIG. 4 depicts a schematic view illustrating the console unit of a printing apparatus according to the embodiment.

FIG. 4 depicts a schematic view illustrating the console unit 204 of the printing apparatus 100 according to the embodiment.

The console unit 204 includes a key input unit 402 capable of accepting a user operation via a hard key, and a touch panel unit 401 serving as an example of a display unit capable of accepting a user operation via a soft key (display key).

Figure 5:
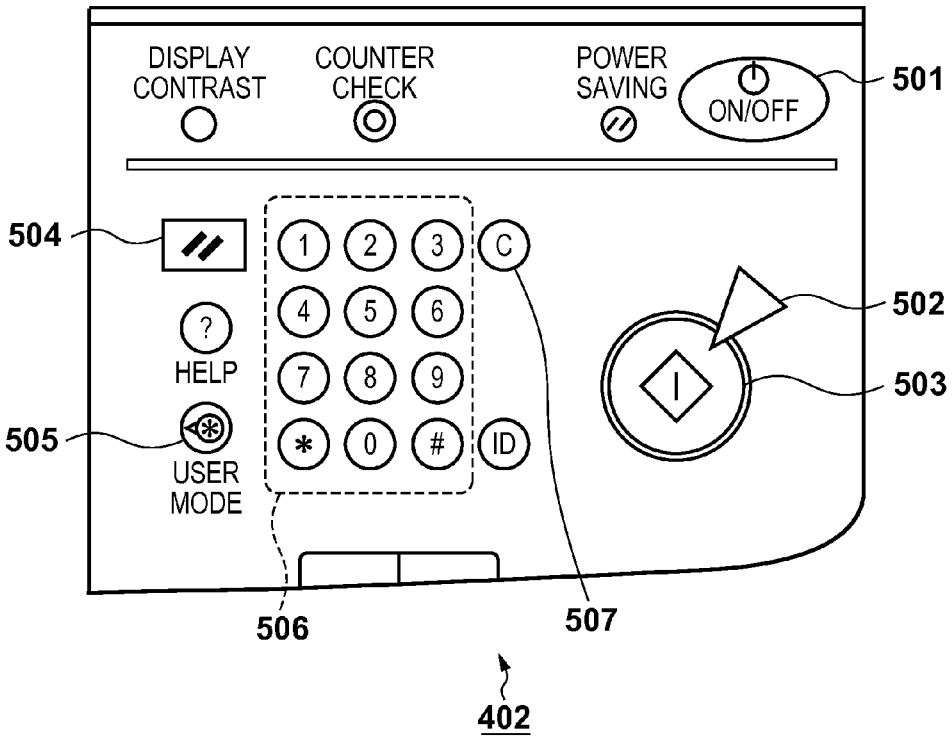
FIG. 5 depicts a schematic view illustrating a key input unit.

FIG. 5 depicts a schematic view illustrating the key input unit 402.

When the user operates a power switch 501, the control unit 205 controls to selectively switch between the standby mode (normal operation state) and the sleep mode. The controller 205 accepts an operation to the power switch 501 when a main power switch (not shown) for supplying power to the overall printing system is ON. In the sleep mode, the printing apparatus 100 suppresses power consumption by stopping programs in wait for an interrupt in preparation for printing of print data from a PC, facsimile reception, and the like.

A start key 503 is used to start processing of a target job. A stop key 502 is used to suspend processing of an accepted job. A ten-key pad 506 includes keys for inputting entries of various settings. A clear key 507 is used to cancel various parameters such as entries set by the user via the ten-key pad 506. A reset key 504 is used to invalidate various settings made by the user for a target job and return set values to defaults. A user mode key 505 is used to shift to a system setting screen for each user.

Figure 6:
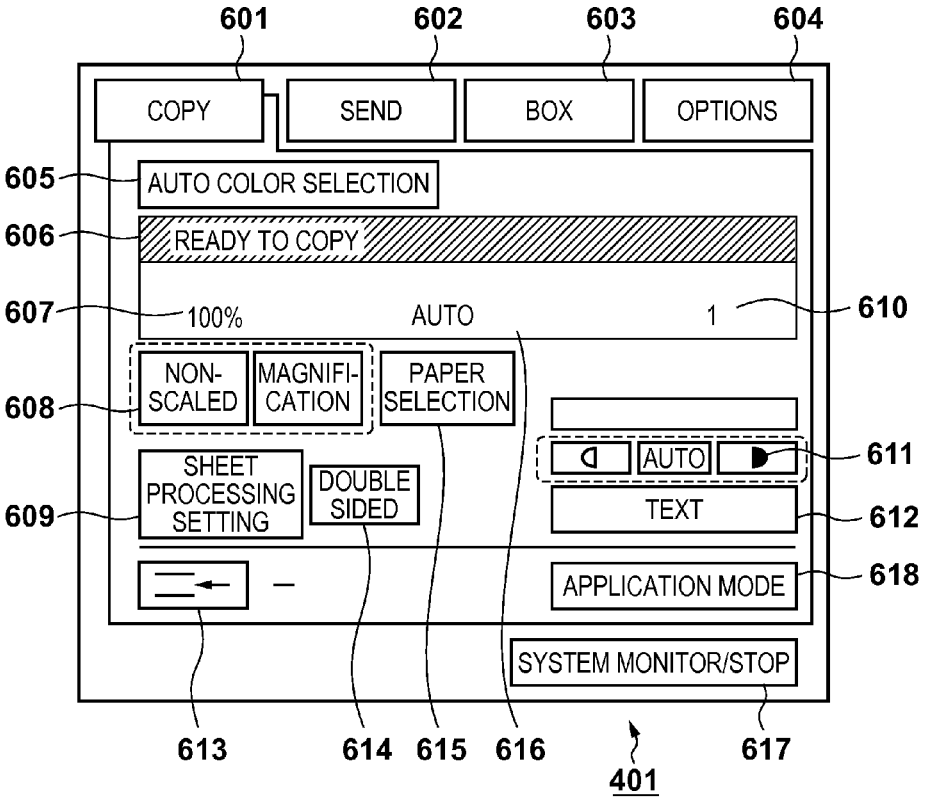
FIG. 6 depicts a view illustrating a touch panel unit.

FIG. 6 depicts a view illustrating the touch panel unit 401.

The touch panel unit 401 is a touch panel display formed from a liquid crystal display unit and a transparent electrode adhered onto the display screen. The touch panel unit 401 has both a function of accepting various settings from the user and a function of presenting information to the user. Upon detecting that the user has pressed a portion corresponding to a display key in a valid display state on the liquid crystal display unit, the CPU of the control unit 205 controls the touch panel unit 401 to display an operation screen corresponding to the key operation in accordance with a display control program stored in advance in the ROM 207. FIG. 6 exemplifies an initial screen which is displayed when the printing apparatus 100 is in the standby mode (state in which there is no job to be processed by the printing apparatus 100).

When the user presses a copy tab 601, the control unit 205 controls the touch panel unit 401 to display an operation screen for the copy function of the printing apparatus 100. When the user presses a send tab 602, the control unit 205 controls the touch panel unit 401 to display an operation screen for the data send function of the printing apparatus 100 such as facsimile or e-mail transmission. When the user presses a box tab 603, the control unit 205 controls the touch panel unit 401 to display an operation screen for the box function of the printing apparatus 100. Note that the box function is a function using a plurality of data storage boxes (to be referred to as boxes) which are virtually set in advance in the HDD 209 and are usable distinctively for respective users. When the user presses an option tab 604, the control unit 205 controls the touch panel unit 401 to display a screen for setting an optional function such as scanner setting. When the user presses a system monitor key 617, the control unit 205 controls the touch panel unit 401 to display a display screen for notifying the user of the state or status of the MFP.

A color selection key 605 is a display key which allows the user to select in advance color copying, monochrome copying, or automatic selection. A magnification setting key 608 is used to display a setting screen which allows the user to execute magnification setting including "non-scaled", enlargement, and reduction. When the user presses a double sided key 614, the control unit 205 controls the touch panel unit 401 to display a screen which allows the user to set which of single sided printing and double sided printing is to be executed in print processing for a job to be printed. When the user presses a paper selection key 615, the control unit 205 controls the touch panel unit 401 to display a screen which allows the user to set a sheet feeding unit, sheet size, and sheet type (medium type) necessary in print processing for a job to be printed. When the user presses a text key 612, the control unit 205 controls the touch panel unit 401 to display a screen which allows the user to select an image processing mode suitable for a document image, such as the text mode or photographic mode. When the user presses a density setting key 611, the control unit 205 allows adjusting the density of an output image of a job to be printed.

Further, the control unit 205 controls the touch panel unit 401 to display a message or the like in a status display field 606 of the touch panel unit 401 so as prompt the user to confirm the status of an event currently generated in the printing apparatus 100, such as a standby state, warming-up, printing, jam, or error. The control unit 205 controls the touch panel unit 401 to display information in a display area 607 so as to prompt the user to confirm the printing magnification of a job to be processed. The control unit 205 controls the touch panel unit 401 to display information in a display area 616 so as to prompt the user to confirm the sheet size and sheet feeding mode of a job to be processed. A display area 610 displays information about the copy count of a job to be processed, and information for prompting the user to confirm the number of a sheet during a print operation. In this manner, the control unit 205 controls the touch panel unit 401 to display various kinds of information the user should be notified of. When the user presses an interrupt key 613, the control unit 205 stops printing a current job by the printing apparatus 100 and allows printing a job designated by the user. When the user presses an application mode key 618, the control unit 205 controls the touch panel unit 401 to display a screen for setting various image processes and layouts such as page consecutive reading, cover sheet/inserting sheet setting, reduction layout, and image movement.

Next, another feature of the embodiment will be described. As a setting of a target job, the control unit 205 controls the touch panel unit 401 to present a display capable of accepting a request from the user to execute sheet processing by the sheet processing unit of the inline type sheet processing apparatus 200 in the printing system 1000. For example, the control unit 205 controls the touch panel unit 401 to display a "sheet processing setting" key 609. When the user presses the "sheet processing setting" key 609, the control unit 205 allows the user to select sheet processing he wants from sheet processing selection candidates executable using inline type sheet processing apparatuses in the printing system 1000. Note that the "sheet processing setting" key 609 will also be called a "finishing key". In the following description, "sheet processing" will also be called "finishing".

As for "punching processing", a need to perform various punching processes (processes of punching a printed sheet) is assumed in the POD environment. Hence, "two-hole punching (processing of forming two holes at a sheet end corresponding to a sheet binding edge)" and "multi-hole punching (processing of forming many holds such as 30 holes at a sheet end)" are exemplified as a plurality of types of punching processes. These processes can be executed by the punching unit of the saddle stitching apparatus in order to cope with the above-described configuration. In other words, these punching processes can be executed using another apparatus or unit. However, as exemplified above, it is configured to permit the use of an apparatus matching the definition of the inline finisher in the printing system 1000 and inhibit the use of an apparatus not matching the definition in the printing system 1000. In this example, when the user presses the "sheet processing setting" key 609, the control unit 205 controls the touch panel unit 401 to display a screen shown in FIG. 7.

Figure 7:
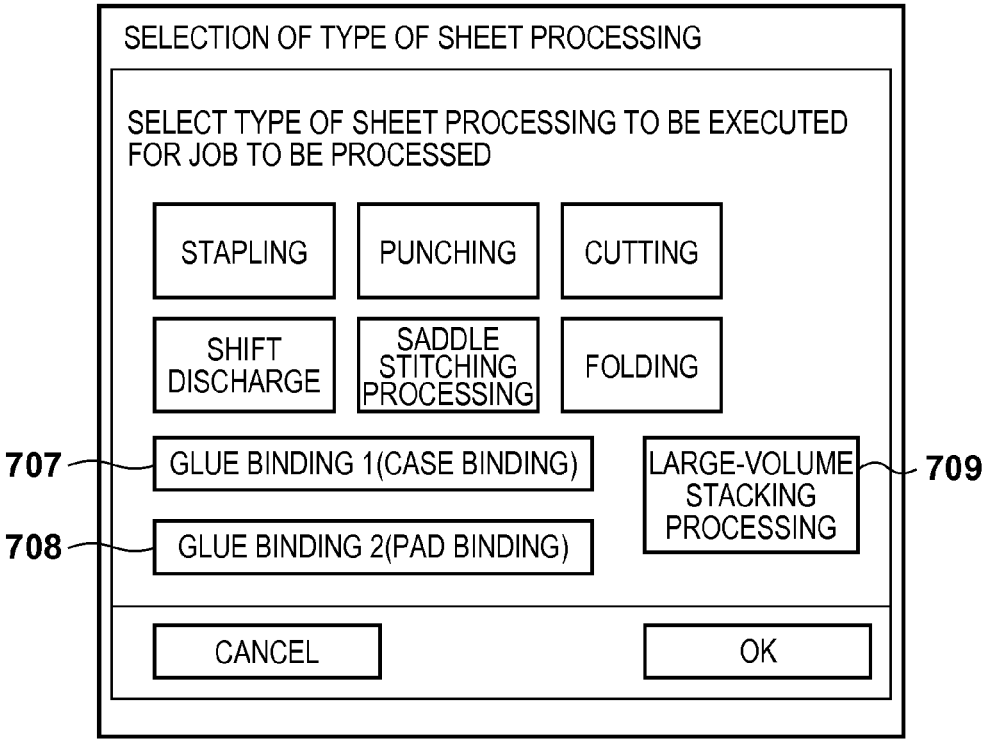
FIG. 7 depicts a view exemplifying a screen which appears to select sheet processing when a sheet processing setting key is pressed.

FIG. 7 depicts a view exemplifying a screen which appears to select sheet processing when the sheet processing setting key 609 is pressed.

The control unit 205 can accept, via the display of FIG. 7, a request to execute sheet processing by the sheet processing apparatus 200 for printed sheets of a target job. The control unit 205 determines sheet processing apparatus candidates selectable in FIG. 7 in accordance with the sheet processing apparatuses of the printing system 1000 and their installation states. For example, in FIG. 7, the control unit 205 can accept a request from the user to execute one of a plurality of types of sheet processes shown in FIG. 7 for sheets printed by the printer unit 203.

FIG. 7 shows an example in which nine types of sheet processes can be selectively executed using inline type sheet processing apparatuses in the printing system 1000. In other words, sheet processes inexecutable in the printing system 1000 are excluded from selection candidates in FIG. 7. For example, when the printing system 1000 does not include a sheet processing apparatus capable of selectively executing case binding processing and pad binding processing, or when the sheet processing apparatus is out of order, either a binding instruction key 707 or 708 in FIG. 7 is not displayed or grayed out. When the printing system 1000 includes a sheet processing apparatus capable of executing sheet processing other than these nine types, a display key capable of accepting a request from the user to execute this sheet processing may be added to the display of FIG. 7. This prevents a user operation error when accepting a sheet processing execution request from the user.

To execute this control, the control unit 205 acquires system configuration information for specifying a sheet processing apparatus arranged as the sheet processing apparatus 200 in the printing system 1000. Also, the control unit 205 acquires, for example, status information representing whether an error has occurred in the sheet processing apparatus 200, and uses it in control. The control unit 205 may acquire these pieces of information when, for example, the user manually inputs them via a UI, or automatically acquire them based on a signal output from the sheet processing apparatus itself via a signal line when the sheet processing apparatus 200 is connected to the printing apparatus 100. On the premise of this configuration, the control unit 205 controls the touch panel unit 401 to display contents based on the acquired information.

Note that the printing system 1000 can accept a target job print request even from an external apparatus such as the PC 103 or 104, and a request for sheet processing necessary for the job. When a job is input from the external apparatus, the same functions as those on the display of FIG. 7 are displayed on the display unit of the external apparatus serving as a print data transmission source. As an example, a printer driver setting screen is displayed on the display unit of a computer serving as the PC 103 or 104. When the UI of the external apparatus executes the display, the control unit of the external apparatus executes the control. For example, when the display unit of the PC 103 or 104 displays a printer driver UI screen (to be described later), the CPU of the PC executes the control.

Figure 8:
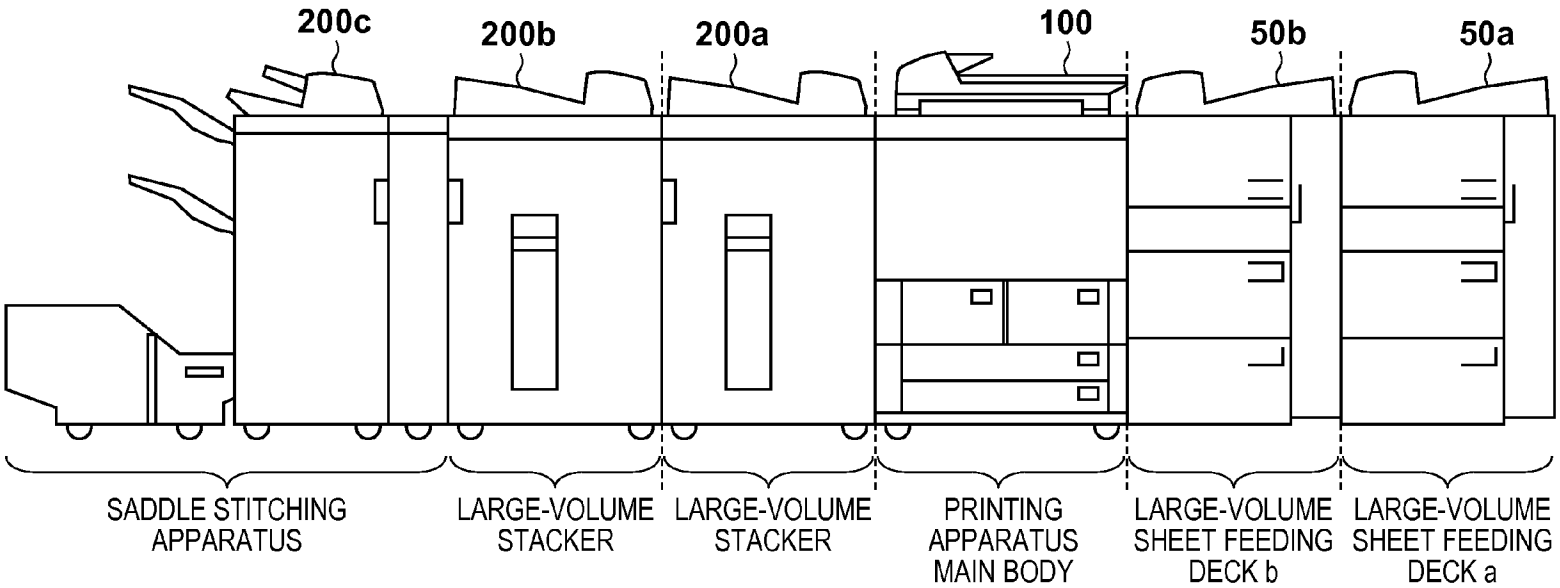
FIG. 8 depicts a view illustrating a case in which sheet processing apparatuses are a saddle stitching apparatus and large-volume stacker in FIG. 3.

FIG. 8 depicts a view illustrating a case in which the sheet processing apparatuses 200 include a saddle stitching apparatus 200*c* and large-volume stackers 200*a*, 200*b* in FIG. 3.

Figure 9:
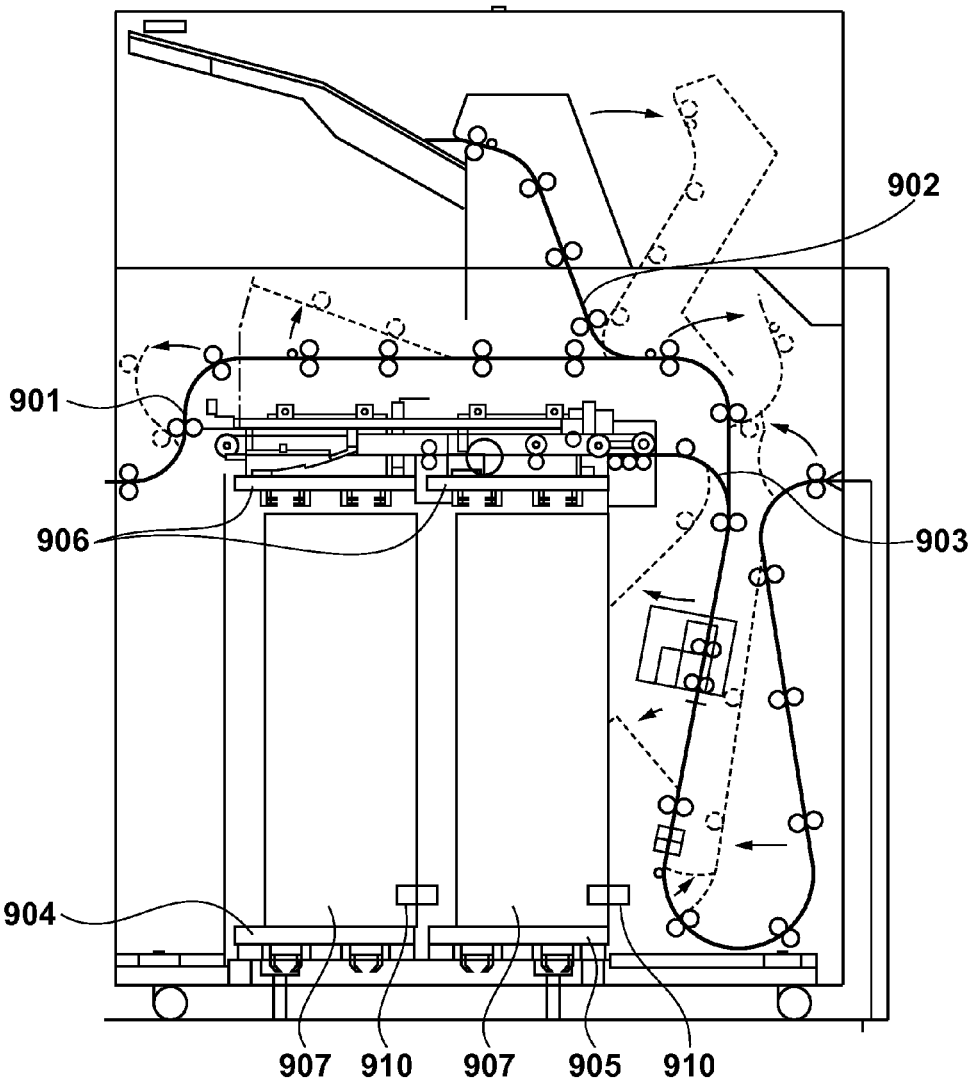
FIG. 9 depicts a view illustrating the internal arrangement of the large-volume stacker according to the embodiment.

FIG. 9 depicts a view illustrating the internal arrangement of the large-volume stacker according to the embodiment.

The large-volume stacker has three conveyance paths, that is, a straight path 901, escape path 902, and stack path 903. The straight path 901 conveys a sheet received from a preceding apparatus to a succeeding apparatus, and is also called a through path in an inline sheet processing apparatus. The straight path 901 is a sheet conveyance path for transferring, to a succeeding apparatus, a sheet of a job requiring no sheet stacking processing by a sheet stacking unit 904 or 905. The escape path 902 is used when discharging a sheet received from a preceding apparatus without stacking it on the sheet stacking unit 904 or 905. For example, when no succeeding sheet processing apparatus is connected and the user is to perform output confirmation work (proof print) or the like, a printed material is conveyed to the escape path 902 and discharged to a discharge tray via the escape path 902 so that the user can pick up the sheet. Note that the sheet conveyance path of the large-volume stacker includes a plurality of sheet sensors necessary to detect the sheet conveyance status and a jam.

The CPU (not shown) of the large-volume stacker notifies the control unit 205 of sheet detection information from each sensor via a signal line configured to communicate data with the control unit 205. Based on the information from the large-volume stacker, the control unit 205 acquires the internal status of the large-volume stacker such as the sheet conveyance status and a jam. When another sheet processing apparatus is cascade-connected between the sheet processing apparatus 200 and the printing apparatus 100, the control unit 205 is notified of sensor information of the large-volume stacker via the CPU of the sheet processing apparatus. Further, the stack path 903 of the large-volume stacker is a sheet conveyance path for executing stacking processing for sheets of a job requiring sheet stacking processing by the sheet stacking unit 904 or 905.

In the system configuration of FIG. 8, for example, when the user presses a "large-volume stacking processing" key 709 in FIG. 7, the control unit 205 controls to convey a sheet to the stack path 903 of the large-volume stacker. The sheet conveyed to the stack path 903 is discharged to the sheet stacking unit 904 or 905 at the position of an abutting plate 906. Each of the sheet stacking units 904 and 905 includes an extensible stay (tray) 907, and sheets are stacked on the stay 907. A dolly is arranged below the stay 907 so that sheets stacked on the stay 907 can be carried to another offline finisher or the like. The stay 907 moves up to an upper position when the front door of the large-volume stacker is closed. As more and more sheets are stacked, the stay 907 contracts to move down the sheet stacking unit 904 or 905. When the operator opens the front door (or inputs an instruction to open it), the sheet stacking unit 904 or 905 moves down to the vicinity of the dolly.

Sheets are stacked on the sheet stacking unit 904 or 905 by flat stacking or shift stacking. Flat stacking literally means always stacking sheets at the same position. Shift stacking is a way of stacking with breaks between sheet bundles by shifting sheets on the far and near sides in the unit of a predetermined copy count or job. The large-volume stacker usable as an inline type sheet processing apparatus can execute a plurality of types of stacking methods when stacking sheets discharged from the printer unit 203. The control unit 205 can instruct the apparatus about these operations.

Figure 11:
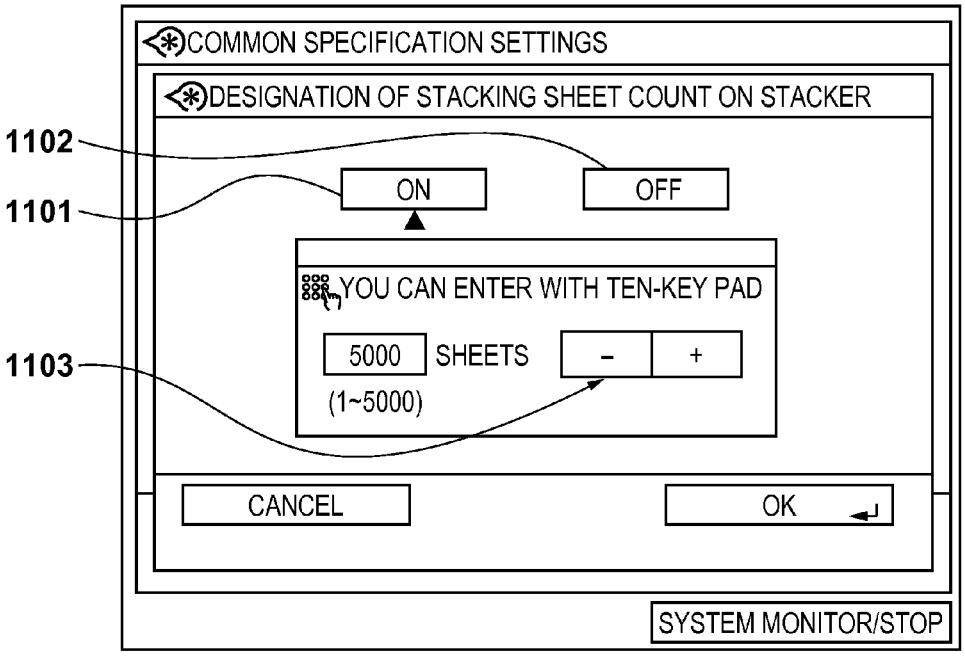
FIG. 11 depicts a view exemplifying a screen for designating a sheet count at which sheets are stacked and stored in the large-volume stacker.

FIG. 11 depicts a view exemplifying a screen for designating a sheet count at which sheets are discharged to and stored in the large-volume stacker.

The touch panel unit 401 of the console unit 204 displays this screen. An "ON" key 1101 is used to validate a function of designating a sheet count at which sheets are stored in the large-volume stacker. An "OFF" key 1102 is used to invalidate the function. When the user presses the "ON" key 1101 to validate the function, and sheets reach a sheet count ("5000" in FIG. 11) designated with a sheet count designation key 1103, sheet stacking processing on the sheet stacking unit ends. When the user presses the "OFF" key 1102, sheets are stacked until a sheet sensor 910 (FIG. 9) of the large-volume stacker detects that the sheet stacking unit becomes full. The sheet count designation key 1103 is used to designate a sheet count at which sheets are stored in the stacker, and allows designating up to the maximum stacking amount (5,000 sheets in this case) of the stacker. In FIG. 11, the "ON" key 1101 is pressed to validate the function, and a value "5,000 sheets" corresponding to the maximum stacking amount is set. On this screen shown in FIG. 11, the user can set not only 5,000 sheets but also an arbitrary value of 1 to 5,000. For example, when the user wants to stack printed materials by dividing them by every 2,000 sheets, he can designate 2,000 sheets via the screen of FIG. 11.

Although not shown in FIG. 11, when a plurality of large-volume stackers are connected as shown in FIG. 8, a stacker designation field may be arranged on the screen of FIG. 11 to designate a large-volume stacker for storing sheets among the plurality of large-volume stackers. Alternatively, when one large-volume stacker incorporates a plurality of sheet stacking units (trays) (FIG. 9), a tray designation field may be arranged on the screen of FIG. 11 to designate a sheet stacking unit for storing sheets among the plurality of sheet stacking units.

Figure 10:
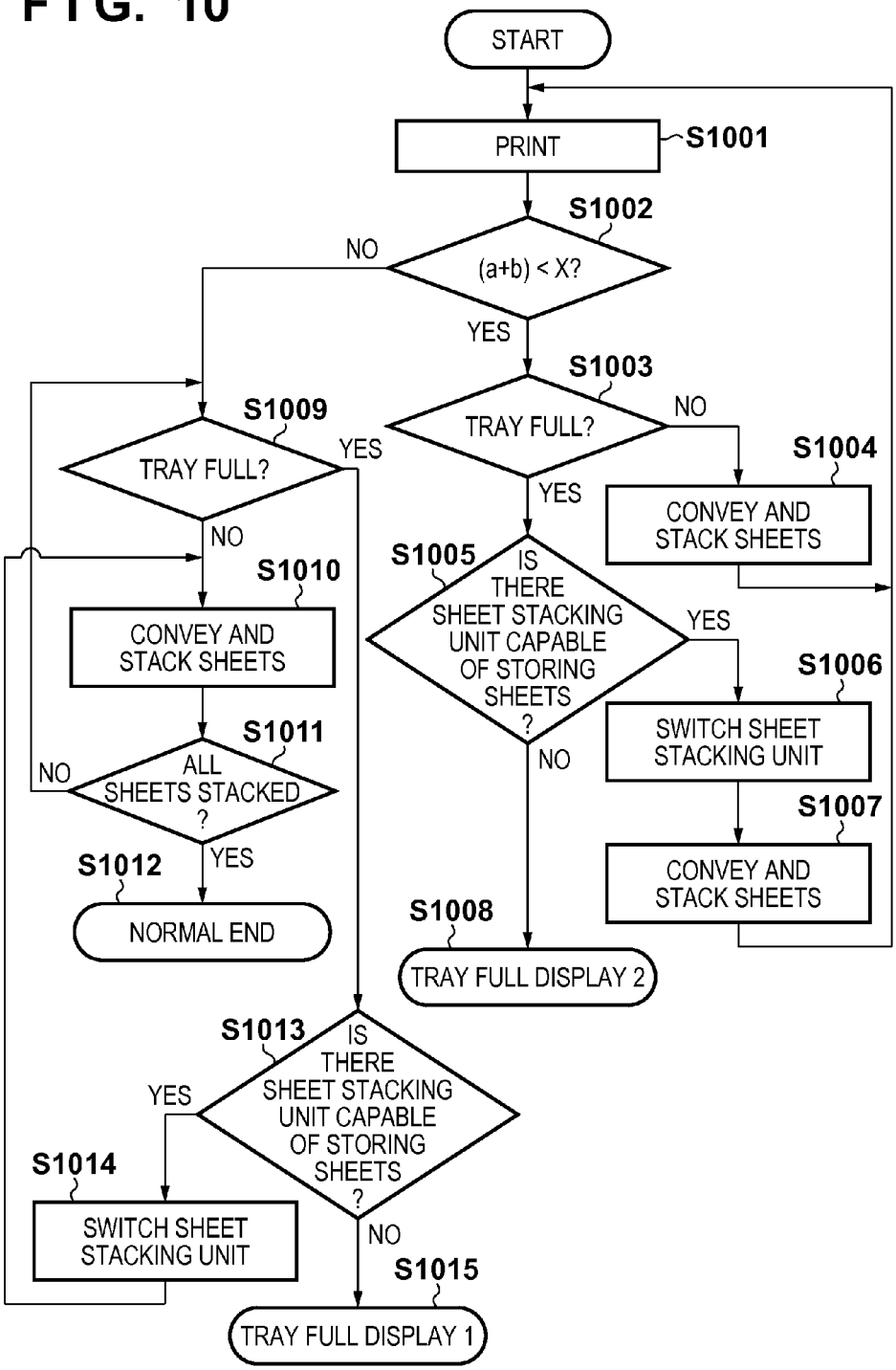
FIG. 10 is a flowchart for describing printing and discharge processing by the printing apparatus.

FIG. 10 is a flowchart for describing printing & discharge control processing by the printing apparatus 100 according to the embodiment. A program for executing this processing is stored in the ROM 207 and executed under the control of the CPU of the control unit 205.

This processing starts after the user uses the above-described screen of FIG. 11 on the console unit 204 of the printing apparatus 100 to set a sheet count at which sheets are stored in the large-volume stacker, and sets a sheet feeding apparatus to which a sheet from the large-volume sheet feeding apparatus 50 is supplied.

Before the start of this processing, it is determined whether the user has pressed the start key 503 to designate the start of copy processing. The process waits until the start key 503 is turned on. After the user presses the start key 503, the process advances to step S1001 to start printing. The process advances to step S1002 to acquire a sheet count a at which sheets have been stacked on the large-volume stacker and a sheet count b at which printed sheets stay in the printing apparatus 100. Then, it is determined whether the sum (a+b) is smaller than a designated sheet count X. If the sum (a+b) is smaller than the designated sheet count X, printing of sheets at the sheet count X has not ended. Thus, the process advances to step S1003 to determine whether the designated sheet stacking unit becomes full (tray full). If the sheet stacking unit does not become full, sheets can be conveyed to and stacked on the designated sheet stacking unit. The process advances to step S1004 to convey printed sheets to the designated sheet stacking unit, and then returns to step S1001. "Full" means not only a case in which the sheet amount has actually reached the maximum storage amount (predetermined amount) of the sheet stacking unit, but also a case in which before the sheet amount reaches the maximum storage amount, the sheet sensor detects that the sheet amount has reached the maximum storage amount owing to a cause such as curl of sheets.

If it is determined in step S1003 that the designated sheet stacking unit becomes full, the process advances to step S1005 to determine whether there is another sheet stacking unit capable of storing sheets. If there is another sheet stacking unit capable of storing sheets, the process advances to step S1006 to determine it as a new sheet stacking unit to switch to the new sheet stacking unit. In step S1007, printed sheets are conveyed to the new sheet stacking unit, and then the process returns to step S1001. If it is determined in step S1005 that there is no other sheet stacking unit capable of storing sheets, the process advances to step S1008 to present tray full display 2. Tray full display 2 represents a state in which the designated sheet stacking unit and other sheet stacking units become full before the completion of printing sheets at the designated sheet count.

If $(a+b) \geq X$ in step S1002, sheets have already been printed at the designated sheet count, so the process advances to step S1009 to determine whether the designated sheet stacking unit becomes full. If the designated sheet stacking unit does not become full, the process advances to step S1010 to convey printed sheets to the designated sheet stacking unit, and then to step S1011. In step S1011, it is determined whether all printed sheets have been stacked on the designated sheet stacking unit. If NO in step S1011, the process returns to step S1009 to execute the above-described processing. Upon completion of stacking all sheets on the sheet stacking unit, the process normally ends in step S1012.

If it is determined in step S1009 that the designated sheet stacking unit becomes full, the process advances to step S1013 to determine whether there is another sheet stacking unit capable of storing sheets. If there is another sheet stacking unit capable of storing sheets, the process advances to step S1014 to determine it as a new sheet stacking unit to switch to the new sheet stacking unit. The process advances to step S1010 to convey printed sheets to the new sheet stacking unit and stack them. If it is determined in step S1013 that there is no other sheet stacking unit capable of storing sheets, the process advances to step S1015 to present tray full display 1. Tray full display 1 represents a state in which printing of sheets at the designated sheet count is complete but the designated sheet stacking unit and other sheet stacking units become full.

The above description assumes a case in which there are a plurality of sheet stacking units. However, when there is only one sheet stacking unit, the process skips determination processing in step S1005 or S1013, and directly shifts to tray full display 2 or 1 in step S1008 or S1015.

Figure 12:
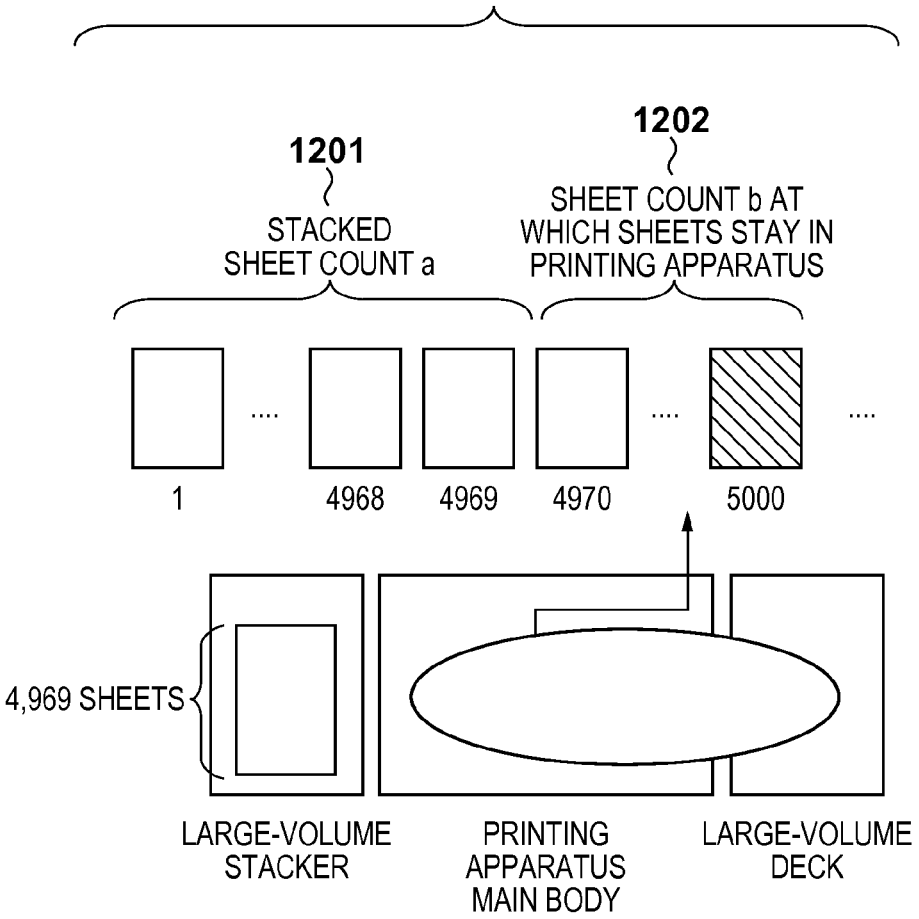
FIG. 12 depicts a view illustrating a state in which it is determined in step S1009 of FIG. 10 that the tray becomes full.

FIG. 12 depicts is a view illustrating a state in which it is determined in step S1009 of FIG. 10 that the tray becomes full.

A case in which a designated sheet stacking unit becomes full when the designated sheet count X is 5,000 will be explained. In this case, 4,969 sheets 1201 have already been stacked on the large-volume stacker, and 5,000 sheets have been printed including sheets (31 sheets) 1202 staying in the printing apparatus 100. If there is another sheet stacking unit capable of storing sheets, the sheet stacking unit is switched to it (step S1014) and the 31 sheets are stacked on the another sheet stacking unit; if NO, tray full display 1 is presented. Tray full display 1 displays an instruction to remove sheets stacked on the designated sheet stacking unit.

Figure 13:
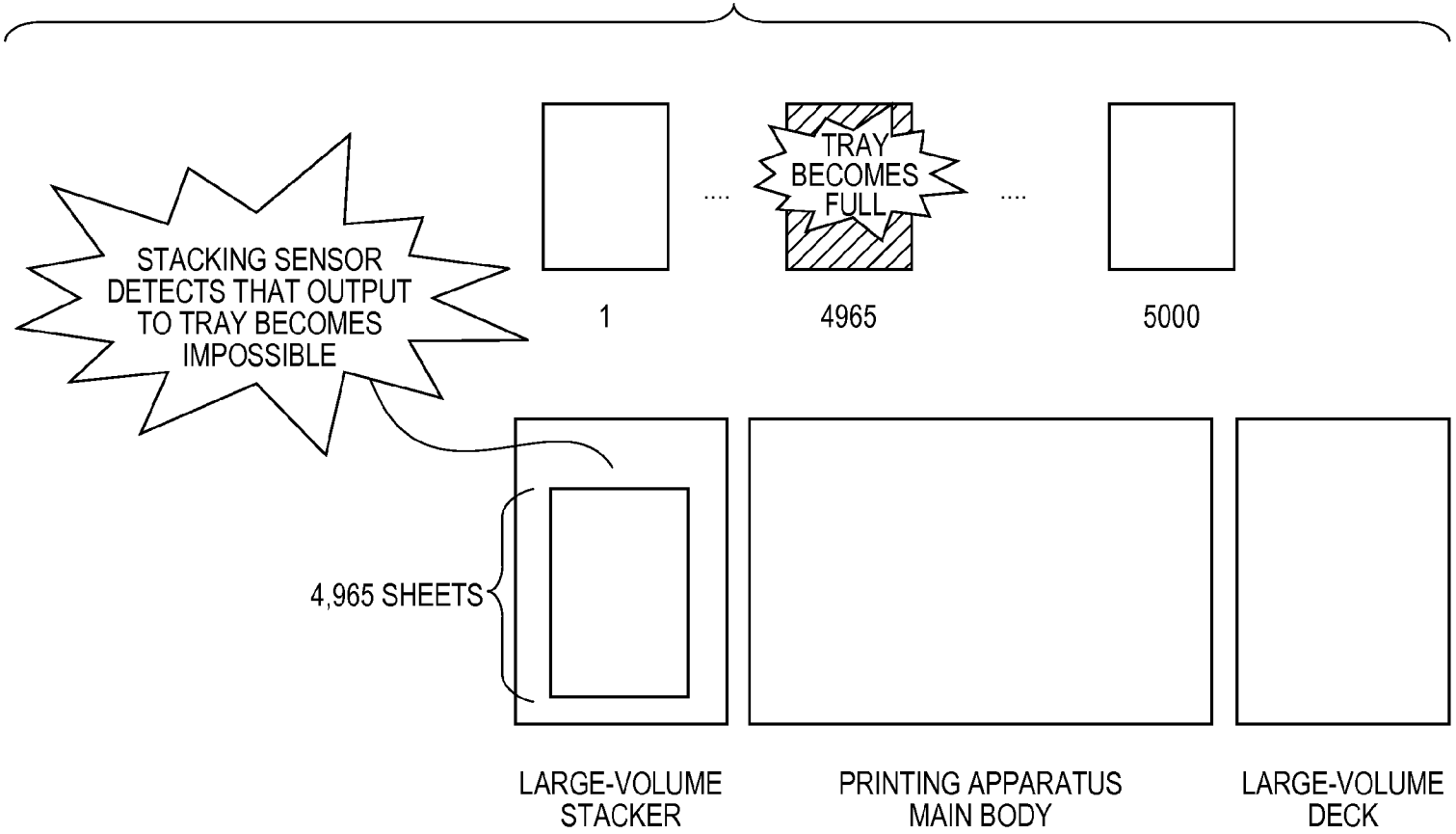
FIG. 13 depicts a view illustrating a case in which it is detected that the tray of the large-volume stacker becomes full before the printed sheet count reaches a designated sheet count.

FIG. 13 depicts a view illustrating a case in which it is detected that the tray of the large-volume stacker becomes full before the printed sheet count reaches the designated sheet count. That is, FIG. 13 shows a case in which it is determined in step S1003 of FIG. 10 that the tray becomes full. In FIG. 13, the sheet sensor 910 detects that the tray becomes full at a sheet count of 4,965.

Figure 14:
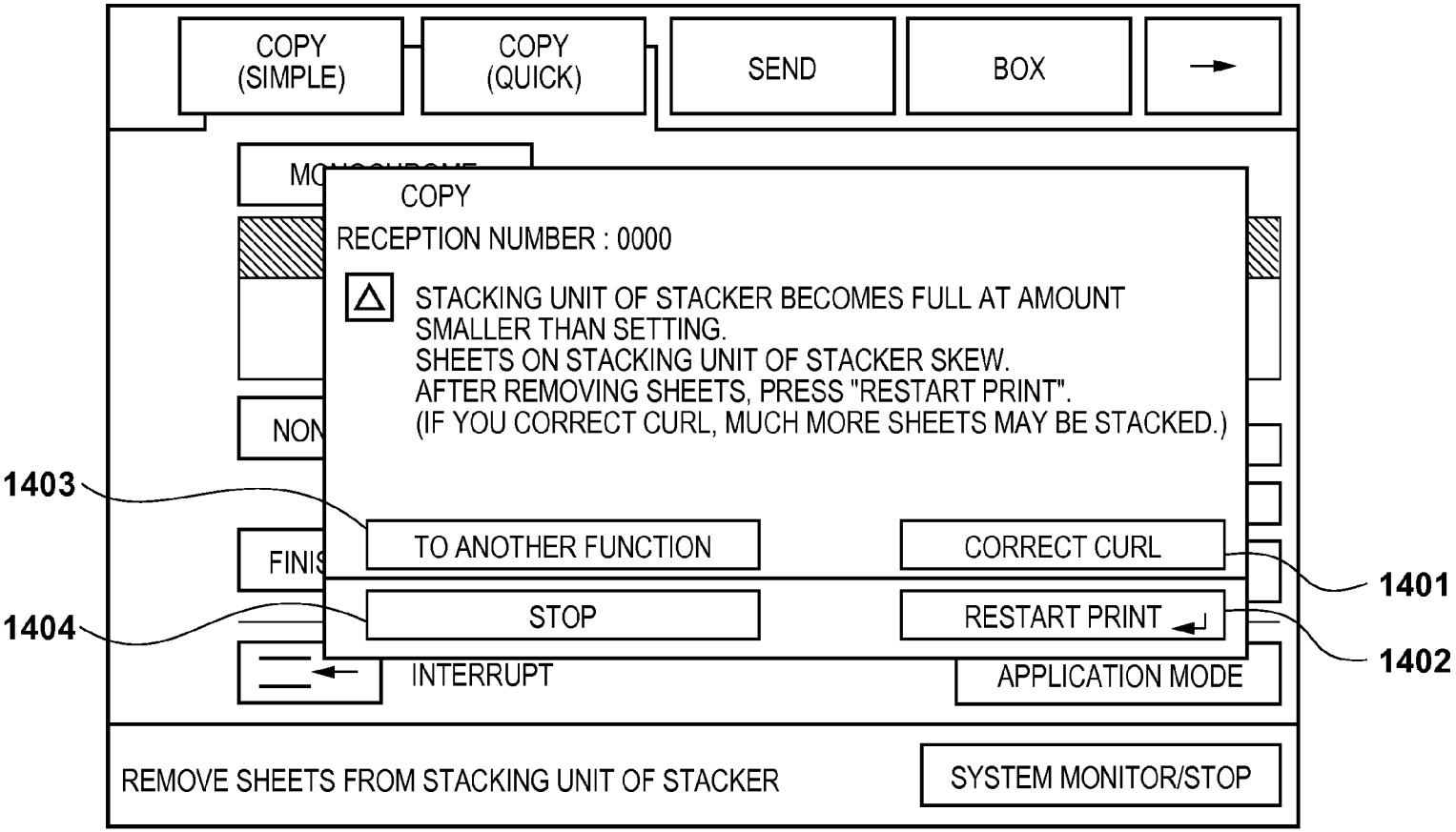
FIG. 14 depicts a view exemplifying a screen representing that sheets have not reached the designated sheet count or the sheet stacking amount is improper in the case of FIG. 13.

FIG. 14 depicts a view exemplifying a screen representing that sheets have not reached the designated sheet count or the sheet stacking amount is improper in the case of FIG. 13.

The example in FIG. 14 assumes that it is detected that the sheet stacking unit becomes full before storing sheets at the designated sheet count because a stacking failure such as curl of sheets has occurred in the large-volume stacker. In this case, the user can be instructed to correct curl of sheets with a "correct curl" key 1401. A "restart print" key 1402 is used to designate restart of printing. A "to another function" key 1403 is used to close the current screen and designate the use of another function. A "stop" key 1404 is used to designate the stop of the current print job.

By the above-described control, a sheet storage count can be designated for a sheet stacking unit which stores sheets, and sheets can be conveyed to and stacked on/stored in the sheet stacking unit. The sheet stacking unit can be switched in accordance with the number of stored sheets.

When a sheet stacking count is designated for a sheet stacking unit which stores sheets, sheets are conveyed to and stored in the sheet stacking unit, and it is detected that the sheet stacking unit becomes full, it can be presented whether the number of sheets stored in the sheet stacking unit has reached the designated sheet count. If this is a detection error owing to a sheet stacking failure on the sheet stacking unit, even a measure (how to deal with) can be presented.

As described above, according to the first embodiment, when a sheet storage count is designated for a sheet stacking unit which stores sheets, and sheets are stored, the user can be notified whether sheets have been stored in the sheet stacking unit at the designated sheet count. Even if it is detected that the sheet stacking unit becomes full before reaching the designated sheet count, the user can be notified of a measure.

Second Embodiment

The second embodiment of the present invention will be described. The hardware arrangements of a system and apparatuses according to the second embodiment are the same as those in the first embodiment, and a description thereof will not be repeated.

Figure 15:
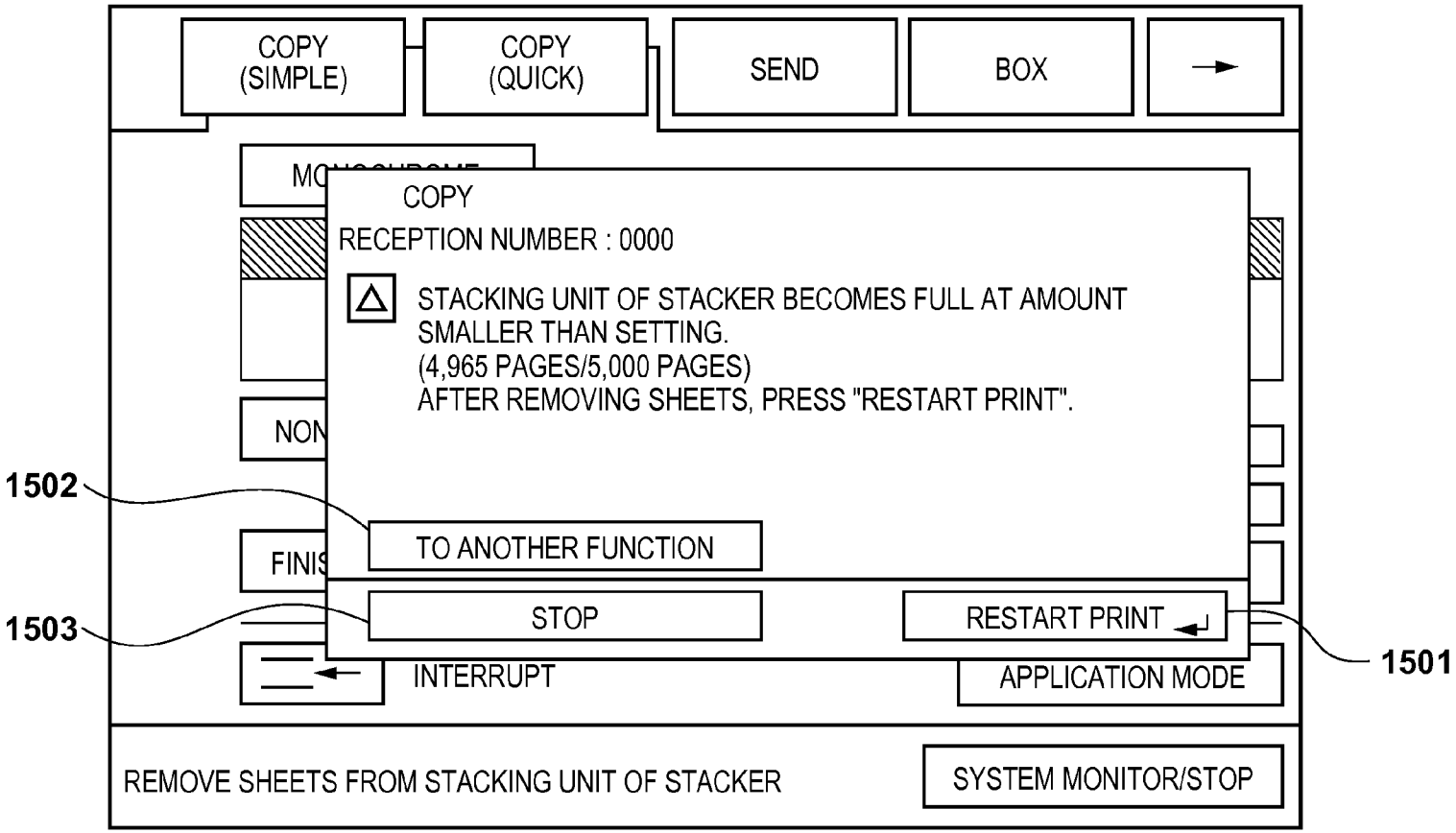
FIG. 15 depicts a view exemplifying a screen when a sheet sensor detects that the tray becomes full in the second embodiment.

FIG. 15 depicts a view exemplifying a screen when the sheet sensor detects that the sheet stacking unit becomes full in the second embodiment. FIG. 15 shows a display example corresponding to tray full display 2 in FIG. 10.

In the case of FIG. 13, the sheet sensor of the sheet stacking unit detects that the tray becomes full at a sheet count of 4,965, and the printed sheet count does not reach the designated sheet count. In this case, the printed sheet count does not reach the designated sheet count and the sheet stacking unit becomes full, as shown in FIG. 13. FIG. 15 shows that the tray becomes full at a sheet count of 4,965 with respect to the designated sheet count (5,000).

A "restart print" key 1501 is used to restart printing by the user. A "to another function" key 1502 is used to close the current screen and designate another function. A "stop" key 1503 is used to designate the stop of the current print job.

By the above-described control, the user can know the number of sheets stored in the sheet stacking unit with respect to a designated sheet count. Also, the user can recognize that the sheet stacking unit becomes full before printing sheets at a designated sheet count.

According to the second embodiment, the user can cope with even a case in which it is detected that the sheet stacking unit becomes full before printing sheets at a designated sheet count.

The printing system according to the above-described embodiments has the following effects.

The printing system can cope with problems assumed in the conventional art. In addition, a user-friendly, convenient printing environment suited not only to the office environment but also to the POD environment can be built. The printing system can meet even needs at actual work site in the printing environment such as the POD environment, including a need to operate the system at maximum productivity and a need to reduce the work load on the operator.

According to the first and second embodiments, when it is determined that the sheet stacking unit becomes full, the sheet stacking unit can be automatically switched to another sheet stacking unit capable of storing sheets, and sheets can be conveyed to and stored in the switched sheet stacking unit. When it is determined that the sheet stacking unit becomes full, the user can be notified whether sheets have been printed at a designated sheet count or whether there is another sheet stacking unit capable of storing sheets.

When a designated tray (first sheet stacking unit) becomes full and is automatically switched to another tray (second sheet stacking unit) during execution of one job, sheets printed by the job and those printed by another job need to be discriminated from each other. In this case, sheet bundles are desirably discriminated from each other on the sheet stacking unit by shift discharge or the like.

When the sheet stacking unit is switched during a job, the display unit of the console unit 204 desirably displays, at the end of the job, a sheet stacking unit to which sheets have been discharged, and the number of sheets discharged to this sheet stacking unit.

In this manner, the printing system can cope with use cases and needs assumed in the POD environment in the conventional art. In addition, a flexible printing environment can be built, and various mechanisms can be provided toward practical application of the product.

In the embodiments, printed sheets are conveyed from the printing apparatus 100 to the large-volume stacker, and stored in the large-volume stacker. However, one or a plurality of large-volume stackers (trays) may be arranged in the printing apparatus and store printed sheets.

The present invention is not limited to the above-described embodiments, and various modifications (including organic combinations of the embodiments) can be made based on the gist of the present invention and are not excluded from the scope of the present invention. For example, in the embodiments, the control unit 205 of the printing apparatus 100 performs various control operations. However, it may be configured to execute some or all of the control operations by an external controller or the like different from the printing apparatus 100.

As described above, according to the embodiments, a user-friendly, convenient printing environment suited not only to the office environment but also to the POD environment can be built. The printing system can meet even needs at actual work site in the printing environment such as the POD environment, including a need to operate the system at high productivity and a need to reduce the work load on the operator.

Regardless of the sheet type, it can be guaranteed that sheets can be stacked on a stacker at a designated sheet count, improving user friendliness. The printing system can cope with use cases and needs assumed in the POD environment, and a flexible printing environment can be built.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-094375, filed Apr. 20, 2011, which is hereby incorporated by reference herein in its entirety.

What is claimed is:

1. A printing apparatus having a stacking unit for stacking sheets on which an image is printed, the printing apparatus comprising:

a detecting unit configured to detect a full status of the stacking unit;

a first setting unit configured to set parameters as a setting of a copy job;

a second setting unit configured to set a number of sheets as a setting of the stacking unit, the number of sheets being different from the set parameters; and a control unit configured to perform a control, after stacking of the sheets on the stacking unit is started, to stop the stacking of the sheets on the stacking unit when the full status is detected by the detecting unit, wherein the control unit is further configured to perform a control, in a case where a predetermined mode is selected, to prevent from stacking sheets more than the number set by the second setting unit as the setting of the stacking unit on the stacking unit, even when the full status is not detected by the detecting unit.

2. The printing apparatus according to claim 1, wherein the control unit is further configured to perform a control, in a case where the predetermined mode is selected, to stop stacking of the sheets on the stacking unit when the full status is detected by the detecting unit, even when an amount of sheets that corresponds to the number set by the second setting unit as the setting of the stacking unit have not been stacked on the stacking unit yet.

3. The printing apparatus according to claim 1, further comprising a notification unit configured to make a predetermined notification to a user, in a case where the predetermined mode is selected and the full status is detected by the detecting unit before an amount of sheets that corresponds to the number set by the second setting unit as the setting of the stacking unit have been stacked on the stacking unit.

4. The printing apparatus according to claim 3, wherein the notification unit is configured to display a message which prompts a user to perform a predetermined setting.

5. The printing apparatus according to claim 4, wherein the predetermined setting is a setting for correcting curl of sheets.

6. The printing apparatus according to claim 1, wherein the number set by the second setting unit as the setting of the stacking unit is accepted from a user.

7. A control method of controlling a printing apparatus having a stacking unit for stacking sheets on which an image is printed, the method comprising the steps of:

detecting a full status of the stacking unit;

setting parameters as a setting of a copy job;

setting a number of sheets as a setting of the stacking unit, the number of sheets being different from the set parameters;

performing a control, after stacking of sheets on the stacking unit is started, to stop the stacking of the sheets on the stacking unit when the full status is detected, and performing a control, in a case where a predetermined mode is selected, to prevent from stacking sheets more than the number set as the setting of the stacking unit on the stacking unit, even when the full status is not detected.

8. A non-transitory computer readable storage medium storing a computer program executable by a processor of a printing apparatus having a stacking unit for stacking sheets on which an image is printed to execute a control method of controlling the printing apparatus, the method comprising the steps of:

detecting a full status of the stacking unit;

setting parameters as a setting of a copy job;

setting a number of sheets as a setting of the stacking unit, the number of sheets being different from the set parameters;

performing a control, after stacking of sheets on the stacking unit is started, to stop the stacking of the sheets on the stacking unit when the full status is detected, and performing a control, in a case where a predetermined mode is selected, to prevent from stacking sheets more than the number set as the setting of the stacking unit on the stacking unit, even when the full status is not detected.

* * * * *